US006887370B2

(12) United States Patent
De Wet et al.

(10) Patent No.: US 6,887,370 B2
(45) Date of Patent: May 3, 2005

(54) SEPARATION OF OXYGENATES FROM A HYDROCARBON STREAM

(75) Inventors: Johan Pieter De Wet, Vanderbijlpark (ZA); Jacob Johannes Scholtz, Sasolburg (ZA)

(73) Assignee: Sasol Technology (Pty) Limited, Sasolburg (ZA)

( * ) Notice: Subject to any disclaimer, the term of this patent is extended or adjusted under 35 U.S.C. 154(b) by 0 days.

(21) Appl. No.: 10/398,783

(22) PCT Filed: Oct. 9, 2001

(86) PCT No.: PCT/IB01/01874

§ 371 (c)(1),
(2), (4) Date: Sep. 22, 2003

(87) PCT Pub. No.: WO02/31085

PCT Pub. Date: Apr. 18, 2002

(65) Prior Publication Data

US 2004/0044263 A1 Mar. 4, 2004

Related U.S. Application Data

(60) Provisional application No. 60/239,060, filed on Oct. 9, 2000.

(30) Foreign Application Priority Data

Oct. 9, 2000 (ZA) ..... 2000/5508

(51) Int. Cl.[7] ..... C07C 7/10; C10G 21/28; C10G 21/02; C10G 21/16

(52) U.S. Cl. ..... 208/862; 585/833; 208/263; 208/313; 208/322; 208/323; 208/333; 208/339

(58) Field of Search ..... 208/263, 313, 208/322, 323, 333, 339; 585/833, 862

(56) References Cited

U.S. PATENT DOCUMENTS 3,725,255 A * 4/1973 Barilli et al. ..... 208/331

FOREIGN PATENT DOCUMENTS

| | | |
|---|---|---|
| GB | 661916 | * 11/1951 |
| GB | 717725 | * 11/1954 |
| WO | WO-99/58625 | * 11/1998 |

* cited by examiner

*Primary Examiner*—Walter D. Griffin
*Assistant Examiner*—Tam M. Nguyen
(74) *Attorney, Agent, or Firm*—C. James Bushman; Browning Bushman P.C.

(57) ABSTRACT

This invention relates to a method for separating olefins and paraffins from oxygenates in a liquid hydrocarbon stream containing a high proportion of olefins, paraffins and oxygenates (mainly alcohols). Typically, the hydrocarbon stream is obtained from a Fischer-Tropsch process. The organic counter-solvent has a boiling point which is less than the boiling point of the most volatile alcohol in the hydrocarbon stream. A raffinate from the liquid-liquid extractor is passed to a distillation column. A bottoms product from the distillation column comprises olefins and paraffins, and the overhead product comprising solvents is recycled. An extract from the liquid-liquid extractor is sent to a stripping column, where a bottoms product containing pure alcohol is obtained. The overhead product containing counter-solvent is recycled.

12 Claims, 1 Drawing Sheet

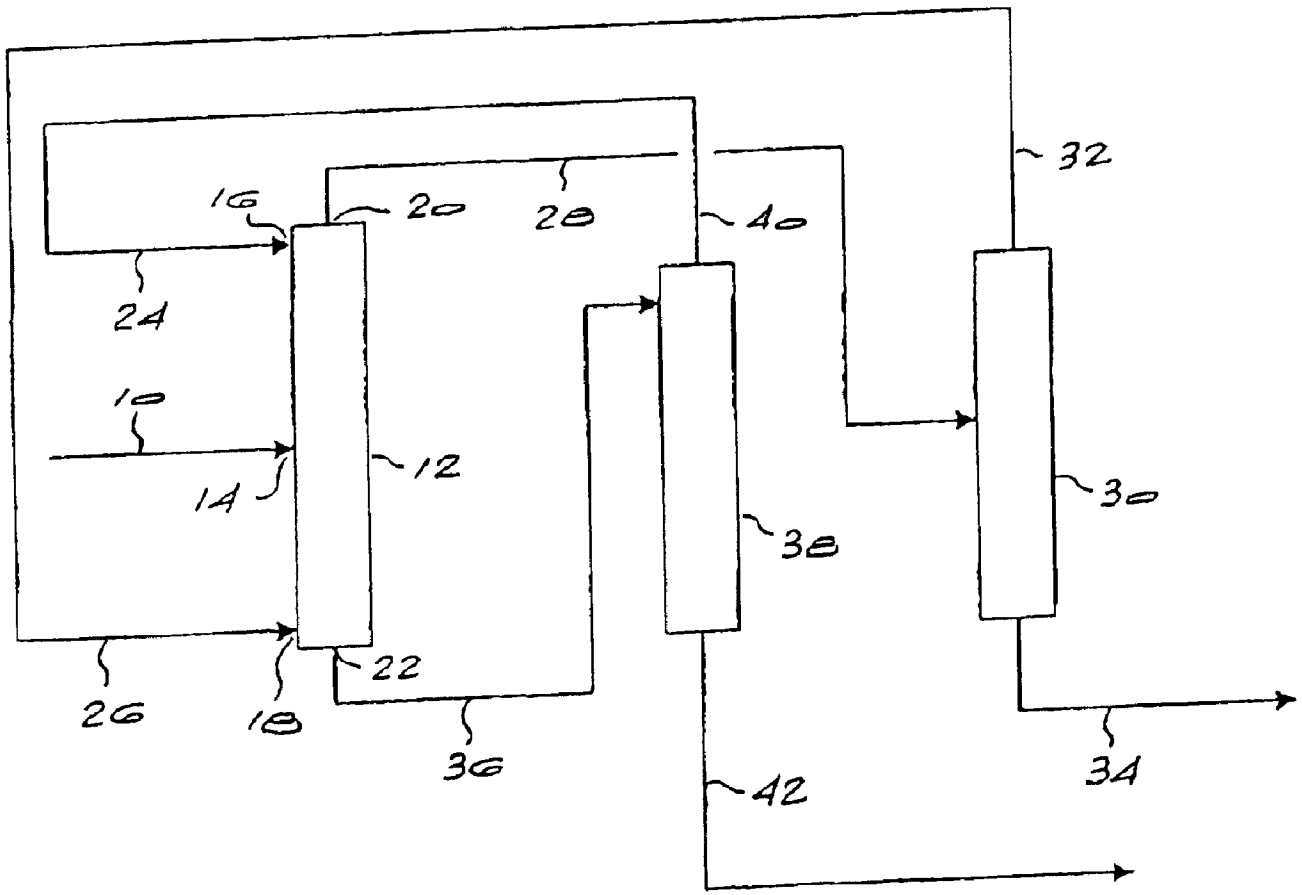
32
30
34
40
38
42
28
36
20
12
22
16
14
10
24
10
26

SEPARATION OF OXYGENATES FROM A HYDROCARBON STREAM

This application claims the benefit of Provisional Application No. 60/239,060, filed Oct. 9, 2000.

BACKGROUND OF THE INVENTION

THIS invention relates to a process for separating olefins and paraffins from oxygenates in a liquid hydrocarbon stream.

The reaction of synthesis gas in a Fischer-Tropsch reactor at elevated temperature and pressure over an Fe or Co catalyst produces a range of hydrocarbons including paraffins, olefins and alcohols, with carbon chain length varying from 1 to greater than 100. The Fischer-Tropsch reaction can occur at a temperature in excess of 300° C. Generally, the operating temperature is in the range of 200° C. to 260° C. utilising fixed bed or slurry phase reactors. The use of a Fe/Mn/Zn catalyst operated at a pressure of 30–60 bar has been shown to display high selectivity to olefins and oxygenates (mainly alcohols) with chain lengths of from 2 to greater than 30.

In a prior art processes for the extraction of alpha olefins from Fischer-Tropsch product streams, the concentration of the desired alpha olefin is increased in a first distillation step, followed by etherification, extractive distillation, adsorption and/or superfractionation steps. South African patent no. 98/4676 teaches an improvement in the process for the recovery of alpha-olefins from a mixed hydrocarbon stream derived from the Fischer-Tropsch process. The process described in this prior art involves three distinct steps:

1) Coarse separation of hydrocarbon products into a low boiling and a high boiling fraction
2) Distillative fine separation of lower and higher boiling fractions
3) Etherification of tertiary olefins following the fine separation. In these processes, tertiary olefins were considered as a problematic component that cannot be separated from the desired alpha olefin readily by conventional distillation in order to produce a product that is of polymer grade.

A known commercial process of removing oxygenates from a hydrocarbon stream includes the hydrogenation of a $C_{10}$ to $C_{13}$ cut of a hydrocarbon stream containing olefins, paraffins and oxygenates. The hydrogenation step removes oxygenates, but also hydrogenates olefins to paraffins, which is undesirable.

U.S. Pat. No. 4,686,317 discloses a process for removing oxygenated impurities from a light ($C_2$ to $C_4$) hydrocarbon stream which includes extracting the oxygenates with a heavy organic polar solvent, water scrubbing the extracted hydrocarbons to recover the dissolved solvent, and combining the solvent phase from the extraction and water phase from the scrubber and distilling to recover the solvent. This process is not concerned with the recovery of oxygenates from the extract.

SUMMARY OF THE INVENTION

According to the invention there is provided a method for separating olefins and paraffins from oxygenates in a liquid hydrocarbon stream including hydrocarbons and oxygenates, the method including contacting the hydrocarbon stream under conditions of liquid-liquid extraction with a polar solvent and a non-polar organic counter-solvent, wherein the organic counter-solvent comprises olefins and/or paraffins.

Preferably, the organic counter-solvent is selected to have a boiling point which is less than the boiling point of the most volatile alcohol in the hydrocarbon stream.

Advantageously, the hydrocarbon stream is passed through a distillation column prior to introduction to the liquid-liquid extraction, to remove $C_1$ to $C_7$ hydrocarbons and $C_1$ to $C_3$ alcohols from the stream. In this case, a suitable organic counter-solvent comprises olefins and/or paraffins in the $C_8$ range.

Advantageously, $C_{21}$—plus, more preferably the $Cl_{19}$—plus hydrocarbons, are also removed from the hydrocarbon stream by distillation prior to the liquid-liquid extraction so that the stream includes $C_4$ to $C_{20}$, preferably $C_4$ to $C_{18}$ hydrocarbons.

The polar solvent for a $C_4$ to $C_{20}$ hydrocarbon stream is typically a light polar solvent which advantageously comprises a mixture of water and an organic liquid such as n-propanol The preferred light polar solvent is however a mixture of water and acetonitrile. Typically, the water comprises no more than the azeotropic composition of water and the organic liquid.

The liquid-liquid extraction may take place in a liquid-liquid extractor apparatus such as a vertical liquid-liquid extraction column or a mixer-settler type extraction unit.

Raffinate from the liquid-liquid extractor may be introduced into a distillation column and a mixture of paraffins and olefins, with a low concentration of oxygenates, may be recovered as a bottoms product from the distillation column.

The overhead product from the distillation column, which includes counter-solvent and a small amount of solvent, is conveniently recycled to the lower counter-solvent inlet of the extraction column.

Extract from the liquid-liquid extractor may be sent to a stripping column, where the solvent and a small amount of counter-solvent are removed as an overhead product, and then recycled to the upper solvent inlet of the extraction column, and the bottoms product from the stripping column is an oxygenate stream containing low concentrations of non-polar material.

According to a preferred embodiment of the invention there is provided a method for separating olefins and paraffins from oxygenates in a liquid hydrocarbon stream comprising $C_4$ to over $C_{20}$ hydrocarbons and oxygenates, the method including the steps of:

- introducing the hydrocarbon stream into a vertical liquid-liquid extraction column, the liquid extraction column including an upper solvent inlet, a lower counter-solvent inlet, an upper raffinate outlet and lower extract outlet;
- introducing a polar solvent described above into the extraction column via the upper solvent inlet; and
- introducing a non-polar counter-solvent described above into the extraction column via the lower counter-solvent inlet.

Advantageously, the hydrocarbon stream is added to the liquid-liquid extraction column, along the liquid-liquid extraction column.

BRIEF DESCRIPTION OF THE DRAWING

The drawing is a flow diagram of a process according to the invention.

DESCRIPTION OF EMBODIMENTS

This invention relates to a method for separating olefins and paraffins from oxygenates in a liquid hydrocarbon stream comprising $C_4$ to over $C_{20}$ hydrocarbons under conditions of liquid-liquid extraction with a polar solvent and a non-polar organic counter-solvent. Although the use of a vertical liquid-liquid extraction column is described, any type of liquid-liquid extraction unit, such as a mixer-settler unit, may be used.

Referring to the diagram, a liquid hydrocarbon stream 10 (hereinafter referred to as the "feed") containing $C_4$ to over $C_{20}$, preferably $C_8$ to $C_{20}$, typically $C_8$ to $C_{18}$, olefins and paraffins, and impurities such as oxygenates (which may include $C_4$ to $C_{16}$ alcohols, ethers, aldehydes, ketones, acids and mixtures thereof) is fed into a vertical liquid-liquid extraction column 12 via a feed inlet 14 along the column. The extraction column 12 includes an upper solvent inlet 16, a lower counter solvent inlet 18, an upper raffinate outlet 20 and a lower extract outlet 22.

The feed may be obtained from a Fischer-Tropsch reaction. In a preferred embodiment, the hydrocarbon stream is the product of a Fischer-Tropsch reaction in a slurry bed reactor using an Fe/Mn/Zn catalyst operated at a pressure of 30–65 bar and at a temperature range of 200° C. to 260° C. The reactor conditions are selected to provide a high proportion of olefins and paraffins, and alcohols. Typically, the condensate comprises olefins, paraffins and up to 55% by mass alcohols. The hydrocarbon stream is passed through a distillation column prior to introduction to the liquid extraction column 12, to remove $C_1$ to $C_7$ hydrocarbons and $C_1$ to $C_3$ alcohols from the stream. An additional distillation column can also be used to remove the heavier hydrocarbons, i.e. $C_{21}$—plus hydrocarbons, if desired. The removal of the light ($C_1$ to $C_3$) alcohols is important, otherwise it will be difficult to remove them from the extract 36 described below.

A polar solvent 24, which in this embodiment of the invention is a light polar solvent mixture of water and acetonitrile, is introduced to the column 12 via the upper inlet 16. By light polar solvent, it is meant that the solvent should be immiscible with the hydrocarbons and have a boiling point lower than that of the oxygenates and the hydrocarbons. Another light solvent that is suitable for hydrocarbon stream containing a wide range of hydrocarbons, i.e. from $C_4$ to $C_{20}$, is a water/n-propanol mixture. A light polar solvent which comprises a mixture of water and acetonitrile, with no more than 19%, by mass, water is however preferred. Water forms a light-boiling azeotrope with acetonitrile. In the present conditions, the water-acetonitrile azeotrope will be the lightest boiling item in the extract. This is advantageous as it aids solvent recovery in the stripper 38 described below. If the water content of the acetonitrile exceeds that of the water acetonitrile azeotrope concentration, there will be excess water after the water-acetonitrile azeotrope has been boiled off. If there are any other components in the extract that may form light-boiling azeotropes with water, it will do so in the presence of the excess water. Such azeotrope(s) may also be boiled to the overheads, and may leave with the solvent. The danger exists that such components may then accumulate in the solvent loop, and this in turn may be detrimental to the efficiency of the separation.

The ratio of solvent to feed must be sufficient to exceed the solubility of the solvent in the hydrocarbons to form two distinct liquid phases. Usually, the solvent to feed ratio will be from 2:1 to 6:1. A low solvent to feed ratio is preferred as less solvent needs to be recovered in the solvent stripper 38 mentioned below. This saves energy by boiling off less solvent as an overhead product.

An organic counter-solvent 26, is introduced to the extraction column 12 via the lower inlet 18. It is important that the counter solvent has a boiling point which is low enough for it to be separated from the most volatile alcohols present in the stream, in the stripper 38 which is described below. In the present case, where the $C_1$ to $C_3$ alcohols have been removed, the boiling point of the counter-solvent must be low enough to be separated from $C_4$ alcohols (n-butanol). A preferred counter-solvent comprises an olefin or paraffin, typically a mixture of olefins and paraffins mixture, in the $C_8$ range. A typical counter-solvent is octene.

The ratio of feed to the counter-solvent should be approximately 2:1. A preferred solvent to counter-solvent ratio is from 1:2 to 1:6, typically 1:4.

A raffinate 28 leaving the upper exit 20 of the extraction column 12 consists of non-polar hydrocarbons, counter-solvent and a small amount of solvent. The raffinate 28 is introduced into a distillation column 30. Counter-solvent and a small amount of solvent is recovered from the raffinate as an overhead product of the distillation column and is recycled to the lower inlet 18 of the extraction column 12. A bottoms product 34 from the distillation column 30 yields a mixture of olefins and paraffins, with low a concentration of oxygenates.

An extract 36 from the lower outlet 22 of the extraction column 12 is sent to a stripper 38. An overhead product 40 from the stripper 38, which contains solvent and small amount of counter solvent is recycled through the upper inlet 16 of the extraction column 12 (it may be necessary to replenish this solvent with a make-up stream to counter losses). A bottoms product 42 from the stripper 38 has a high concentration of oxygenates, and low concentration of non-polar material. As mentioned above, any counter-solvent in the extract has a boiling point of less than the boiling point of the most volatile alcohol and this leaves the stripper as an overhead product and does not contaminate bottoms product, an important constituent of which is n-butanol. The n-butanol can be separated for use as a high-grade product. Thus, a particular advantage of this invention is that the separation results in a good product yield, not only of olefins and paraffins, but also of alcohols.

The process of the invention provides good separation between olefins, paraffins and oxygenates over a hydrocarbon material range of from $C_4$ to over $C_{20}$. The use of olefin-paraffin counter solvent avoids the complication of adding a second foreign solvent to the process. The boiling point of the counter-solvent is also important to ensure that n-butanol is separated from any counter-solvent in the extract stripper column, In addition, the process yields a substantially pure and useful alcohol product, as well as an olefin/paraffin product.

EXAMPLE

A 3 m vertical rotating disc extractor column, which is a multi-stage contacting device, was operated under conditions of liquid-liquid extraction. The column was fitted with feed points at the top bottom, and in-between. The solvent consisted of 18% water in acetonitrile. The solvent was fed at the top feed point at a feed rate of 2 kg/h. The counter-solvent was 1-octene (co-monomer grade). The counter-solvent was introduced at the bottom feed point at a height of 2 m at a rate of 1 kg/h. The feed was obtained from a condensate from a Fischer-Tropsch reaction in a slurry bed using a Fe/Mn/Zn catalyst operated at a pressure of 45 bar and a temperature of 230° C. The extraction operation was executed at 45° C. The solvent formed the continuous phase, and the interface was at the top of the column. For the particular set of accompanying results, the column's rotator was switched off.

Table 1 below shows the percent, by mass, of paraffins, olefins and alcohols in the hydrocarbon feed stream. The rest of the feed is made up from ketones, aldehydes, esters and isomers (branched alcohols, aldehydes, ketones, acids, esters and acetals).

Table 2 shows the percent, by mass, of paraffins, olefins and alcohols in the raffinate from the abovementioned extraction column. The rest of the composition is made up by ketones, aldehydes, esters and isomers.

Table 3 shows the percent, by mass, of alcohols in the extract. The rest of the extract is made up by aldehydes, ketones, esters and isomers.

The raffinate is then passed through a distillation column having a top temperature of 86° C., a bottom temperature of 200° C. and 25 sieve trays. The distillation column is operated at a pressure of 150 kpa with a reflux ratio of 2. Table 4 below shows the composition of the overhead product and the bottoms product from this distillation column It will be seen that the overhead product contains a high percentage of octene and octane which is recycled to the extraction column for use as the counter-solvent. The bottoms product is a mixture of olefins and paraffins, with low concentrations of oxygenates.

The extract is passed through a stripper having a top temperature of 88° C., a bottoms temperature of 106° C. and 25 sieve trays, The stripper is operated at a pressure of 150 kpa. The composition of the overhead product and the bottoms product from the stripper is shown in Table 4. It will be seen that the overhead product contains a high percentage of solvent (a mixture of acetonitrile and water), which is conveniently recycled to the extraction column. The bottoms product contains a high percentage of alcohols.

TABLE 1

| Carbon No. | n-Paraffin Mass % | a-Olefins Mass % | 1-Alcohols Mass % |
|---|---|---|---|
| 3 | 0 | 0 | 0 |
| 4 | 0 | 0 | 1.2 |
| 5 | 0 | 0 | 4.2 |
| 6 | 0 | 0 | 4.2 |
| 7 | 0 | 0 | 3.9 |
| 8 | 0.3 | 0.3 | 3.2 |
| 9 | 3.8 | 3.3 | 2.3 |
| 10 | 4.3 | 3.8 | 1.5 |
| 11 | 4.0 | 3.4 | 0.9 |
| 12 | 3.4 | 2.7 | 0.6 |
| 13 | 2.7 | 2.3 | 0.3 |
| 14 | 2.1 | 1.8 | 0.1 |
| 15 | 1.6 | 1.2 | 0.1 |
| 16 | 1.1 | 0.7 | 0 |
| 17 | 0.8 | 0.4 | 0 |
| 18 | 0.5 | 0.3 | 0 |
| 19 | 0.3 | 0.1 | 0 |
| 20 | 0.2 | 0.1 | 0 |
| 21 | 0.1 | 0 | 0 |
| 22 | 0.1 | 0 | 0 |
| Total | 25.3 | 20.4 | 22.5 |

TABLE 2

| Carbon No. | n-Paraffin Mass % | a-Olefins Mass % | 1-Alcohols Mass % |
|---|---|---|---|
| 6 | 0.1 | 0 | 0 |
| 7 | 0.1 | 0 | 0.2 |
| 8 | * | * | 0.4 |
| 9 | 5.1 | 3.4 | 0.3 |

TABLE 2-continued

| Carbon No. | n-Paraffin Mass % | a-Olefins Mass % | 1-Alcohols Mass % |
|---|---|---|---|
| 10 | 10.0 | 6.4 | 0.5 |
| 11 | 9.4 | 5.4 | 0.6 |
| 12 | 8.4 | 4.1 | 0.5 |
| 13 | 6.8 | 2.8 | 0.4 |
| 14 | 5.1 | 1.7 | 0.3 |
| 15 | 3.5 | 0.9 | 0.2 |
| 16 | 2.3 | 0.5 | 0.2 |
| 17 | 1.5 | 0.2 | 0.1 |
| 18 | 1.0 | 0.1 | 0.1 |
| 19 | 0.7 | 0.1 | 0.1 |
| 20 | 0.5 | 0.1 | 0 |
| 21 | 0.3 | 0.1 | 0 |
| 22 | 0.3 | 0 | 0 |
| 23 | 0.2 | 0 | 0 |
| 24 | 0.2 | 0 | 0 |
| 25 | 0.1 | 0 | 0 |
| 26 | 0.1 | 0 | 0 |
| 27 | 0.1 | 0 | 0 |
| 28 | 0.1 | 0 | 0 |
| 29 | 0.1 | 0 | 0 |
| Total | 56.0 | 25.8 | 3.9 |

TABLE 3

| Carbon No. | Alcohols Mass % |
|---|---|
| 3 | 0.1 |
| 4 | 4.2 |
| 5 | 20.8 |
| 6 | 18.6 |
| 7 | 14.6 |
| 8 | 10.0 |
| 9 | 6.1 |
| 10 | 3.4 |
| 11 | 1.9 |
| 12 | 0.9 |
| 13 | 0.4 |
| 14 | 0.1 |
| 15 | 0.1 |
| Total | 81.2 |

TABLE 4

| | Extract | | Raffinate | |
|---|---|---|---|---|
| | Overhead | Bottoms | Overhead | Bottoms |
| MECN | 72.2 | 0.0 | 6.7 | 0.0 |
| WATER | 17.0 | 0.0 | 0.6 | 0.0 |
| BUOH | 0.9 | 13.3 | 0.2 | 0.0 |
| HEPTENE | 0.2 | 0.0 | 2.1 | 0.0 |
| NHEPTANE | 0.4 | 0.0 | 4.4 | 0.0 |
| PEOH | 0.2 | 13.0 | | 0.0 |
| OCTENE | 4.9 | 0.0 | 53.3 | 3.4 |
| OCTANE | 1.6 | 0.0 | 24.2 | 4.4 |
| HEXOH | 0.1 | 12.0 | 0.0 | 0.0 |
| NONENE | 0.1 | 0.0 | 0.2 | 4.2 |
| NONANE | 0.0 | | 0.1 | 4.7 |
| HEPOH | 0.0 | 10.8 | 0.0 | 0.0 |
| DECENE | 0.0 | | 0.0 | 3.0 |
| DECANE | 0.0 | | 0.0 | 4.5 |
| OCTOH | 0.0 | 9.3 | 0.0 | 0.0 |
| UNDECENE | 0.0 | | 0.0 | 3.2 |
| UNDECANE | 0.0 | | 0.0 | 4.6 |
| NONOH | 0.0 | 8.4 | 0.0 | 0.0 |
| DODECENE | 0.0 | | 0.0 | 2.6 |
| DODECANE | 0.0 | | 0.0 | 4.4 |
| DECANOL | 0.0 | 7.0 | 0.0 | 0.0 |

TABLE 4-continued

| | Extract | | Raffinate | |
|---|---|---|---|---|
| | Overhead | Bottoms | Overhead | Bottoms |
| TRIDECEN | 0.0 | | 0.0 | 2.5 |
| TRIDECAN | 0.0 | | 0.0 | 4.7 |
| UNDECOH | 0.0 | 5.7 | 0.0 | 0.0 |
| C14ENE | 0.0 | | 0.0 | 2.3 |
| C14ANE | 0.0 | | 0.0 | 4.5 |
| DODECOH | 0.0 | 4.5 | 0.0 | 0.0 |
| C15ENE | 0.0 | | 0.0 | 1.9 |
| C15ANE | 0.0 | | 0.0 | 4.4 |
| TRIDECOH | 0.0 | 4.0 | 0.0 | 0.1 |
| C16ENE | 0.0 | | 0.0 | 1.6 |
| C16ANE | 0.0 | | 0.0 | 4.1 |
| C14OH | 0.0 | 3.0 | 0.0 | 0.4 |
| C17ENE | 0.0 | | 0.0 | 1.3 |
| C17ANE | 0.0 | | 0.0 | 3.9 |
| C15OH | 0.0 | 1.1 | 0.0 | 1.0 |
| C18ENE | 0.0 | | 0.0 | 1.0 |
| C18ANE | 0.0 | | 0.0 | 3.6 |
| C16OH | 0.0 | | 0.0 | 1.2 |
| C19ENE | 0.0 | | 0.0 | 0.8 |
| C19ANE | 0.0 | | 0.0 | 3.3 |
| C20ANE | 0.0 | 0.0 | 0.0 | 3.5 |
| C21ANE | 0.0 | 0.0 | 0.0 | 3.0 |
| C22ANE | 0.0 | 0.0 | 0.0 | 2.4 |
| C23ANE | 0.0 | 0.0 | 0.0 | 2.0 |
| C24ANE | 0.0 | 0.0 | 0.0 | 1.5 |
| C25ANE | 0.0 | 0.0 | 0.0 | 1.2 |
| C26ANE | 0.0 | 0.0 | 0.0 | 0.8 |
| C27ANE | 0.0 | 0.0 | 0.0 | 0.6 |
| C28ANE | 0.0 | 0.0 | 0.0 | 0.4 |
| C29ANE | 0.0 | 0.0 | 0.0 | 0.3 |
| C30ANE | 0.0 | 0.0 | 0.0 | 0.3 |
| Other | 2.4 | 8.0 | 8.2 | 2.4 |
| Total | 100.0 | 100.0 | 100.0 | 100.0 |

What is claimed is:

1. A method for separating olefins and paraffins from oxygenates in a liquid $C_4$ to $C_{20}$ hydrocarbon stream including hydrocarbons and oxygenates, comprising contacting the hydrocarbon stream under conditions of liquid-liquid extraction with a polar solvent and a non-polar organic counter-solvent, and obtaining a raffinate and extract from the liquid-liquid extraction; wherein the polar solvent is a light polar solvent and the non-polar organic counter-solvent in the liquid-liquid extraction is a recycled product from the raffinate and comprises olefins or olefins and paraffins.

2. The method according to claim 1 wherein the organic counter-solvent is selected to have a boiling point which is less than the boiling point of the most volatile oxygenate in the hydrocarbon stream.

3. The method according to claim 1 or 2 wherein the $C_4$ to $C_{20}$ hydrocarbon stream is prepared from a hydrocarbon stream which is passed through a distillation column prior to introduction into a liquid-liquid extraction column, to remove $C_1$ to $C_7$ hydrocarbons and $C_1$ to $C_3$ alcohols from the stream, and wherein $C_{19}$-plus hydrocarbons are removed from the hydrocarbon stream by distillation prior to liquid-liquid extraction so that the stream comprises $C_4$ to $C_8$ hydrocarbons.

4. The method according to claim 3 wherein the organic counter-solvent comprises olefins and/or paraffins in the $C_8$ range.

5. The method according to claim 3 wherein $C_{21}$-plus hydrocarbons are removed from the hydrocarbon stream by distillation prior to the liquid-liquid extraction so that the stream comprises $C_4$ to $C_{26}$ hydrocarbons.

6. The method according to claim 5 wherein the solvent comprises a mixture of water and an organic liquid.

7. The method according to claim 6 wherein the light polar solvent is a mixture of water and acetonitrile.

8. The method according to claim 7 wherein the water comprises no more than 19% of the solvent.

9. The method according to claim 1 wherein the raffinate from the liquid-liquid extraction is introduced into a distillation column and a mixture of paraffins and olefins is recovered as a bottoms product from the distillation column.

10. The method of claim 3 wherein an overhead product from the distillation column is recycled and used as the non-polar organic counter-solvent in the liquid-liquid extraction.

11. The method according claim 3 wherein an extract from the liquid-liquid extraction is sent to a stripping column, and an overhead product from the stripping column is recycled to the upper solvent inlet of the extraction column.

12. The method according to claim 11 wherein the bottoms product from the stripping column is an oxygenate stream containing low concentrations of non-polar material.

* * * * *

UNITED STATES PATENT AND TRADEMARK OFFICE

CERTIFICATE OF CORRECTION

PATENT NO. : 6,887,370 B2
APPLICATION NO. : 10/398783
DATED : May 3, 2005
INVENTOR(S) : Johan Pieter De Wet et al.

It is certified that error appears in the above-identified patent and that said Letters Patent is hereby corrected as shown below:

In column 8, line 11, delete "$C_{19}$" and insert therefor --$C_{21}$--.

In column 8, line 13, delete "$C_8$" and insert therefor --$C_{20}$--.

In column 8, line 18, delete "$C_{21}$" and insert therefor --$C_{19}$--.

In column 8, line 21, delete "$C_{26}$" and insert therefor --$C_{18}$--.

Signed and Sealed this
Nineteenth Day of April, 2011

David J. Kappos

David J. Kappos
*Director of the United States Patent and Trademark Office*